US011109691B2

(12) United States Patent
Fusco et al.

(10) Patent No.: US 11,109,691 B2
(45) Date of Patent: Sep. 7, 2021

(54) COLLAPSIBLE PLAYARD

(71) Applicant: SUMMER INFANT (USA), INC., Woonsocket, RI (US)

(72) Inventors: Michael Thomas Fusco, Greenville, RI (US); Anthony Carbone, Harrisville, RI (US); Sean Foster, West Warwick, RI (US); Dana E. Chicca, Somerset, MA (US); Paul MacPhail Brown, Slatersville, RI (US)

(73) Assignee: SUMMER INFANT (USA), INC., Woonsocket, RI (US)

( * ) Notice: Subject to any disclaimer, the term of this patent is extended or adjusted under 35 U.S.C. 154(b) by 88 days.

(21) Appl. No.: 16/405,729

(22) Filed: May 7, 2019

(65) Prior Publication Data

US 2020/0352353 A1 Nov. 12, 2020

(51) Int. Cl.
*A47D 13/06* (2006.01)
*A47D 5/00* (2006.01)

(52) U.S. Cl.
CPC ..... *A47D 13/063* (2013.01); *A47D 5/00* (2013.01); *A47D 13/061* (2013.01); *A47D 13/066* (2013.01)

(58) Field of Classification Search
CPC .... A47D 13/063; A47D 13/06; A47D 13/061; A47D 13/068; A47D 11/007
See application file for complete search history.

(56) References Cited

U.S. PATENT DOCUMENTS 9,907,411 B2 * 3/2018 Burns ..... A47D 5/00
10,448,752 B1 * 10/2019 Flannery ..... A47D 13/063
10,557,282 B1 * 2/2020 Flannery ..... A47D 13/06

* cited by examiner

*Primary Examiner* — David R Hare
*Assistant Examiner* — Madison Emanski
(74) *Attorney, Agent, or Firm* — Adler Pollock & Sheehan P.C

(57) ABSTRACT

A playard includes a collapsible frame having scissoring members vertically extending and forming sides, the frame lacking horizontal top members, a removable fabric enclosure, the removable fabric enclosure including a removable top portion, and a removable bottom portion, the removable top portion secured to an upper portion of the collapsible frame with an attachment device configured to removably engage corresponding receptacles in the upper collapsible frame.

18 Claims, 6 Drawing Sheets

COLLAPSIBLE PLAYARD

BACKGROUND OF THE INVENTION

The present invention relates generally to child enclosures, and more particularly to a collapsible playard.

Formerly known as "playpens," playards generally provide a safe space for a baby or toddler to play when one needs kid-free time to cook dinner, get ready for work, or take a bathroom break. Generally rectangular and made from mesh, playards sit directly on or slightly elevated off the floor and are typically designed for easy transport.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In an aspect, the invention features a playard including a collapsible frame having scissoring members vertically extending and forming sides, the frame lacking horizontal top members, a removable fabric enclosure, the removable fabric enclosure including a removable top portion, and a removable bottom portion, the removable top portion secured to an upper portion of the collapsible frame with an attachment device configured to removably engage corresponding receptacles in the upper collapsible frame.

In another aspect, the invention features a playard including a collapsible frame having scissoring members vertically extending and forming sides, the frame lacking horizontal top members, and a removable child support accessory, the removable child support accessory including attachment structures, the attachment structures configured to attachably detach to corresponding mating elements located on corresponding sides of an upper portion of the collapsible frame.

In another aspect, the invention features a playard including a collapsible frame having scissoring members vertically extending and forming sides, the frame lacking horizontal top members, and a removable child support accessory, the removable child support accessory including a generally polygonal shaped structure connected to at least two corners of a snap feature of an upper portion of the collapsible frame with attachment structures.

In another aspect, the invention features a playard including a collapsible frame having scissoring members vertically extending and forming sides, the frame lacking horizontal top members, a removable canopy adapted to fold with the collapsible frame, the removable canopy including clips attached to the bottom ends of the support structure, the clips hinged with two clips, opposite each other, the two clips attached independently.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
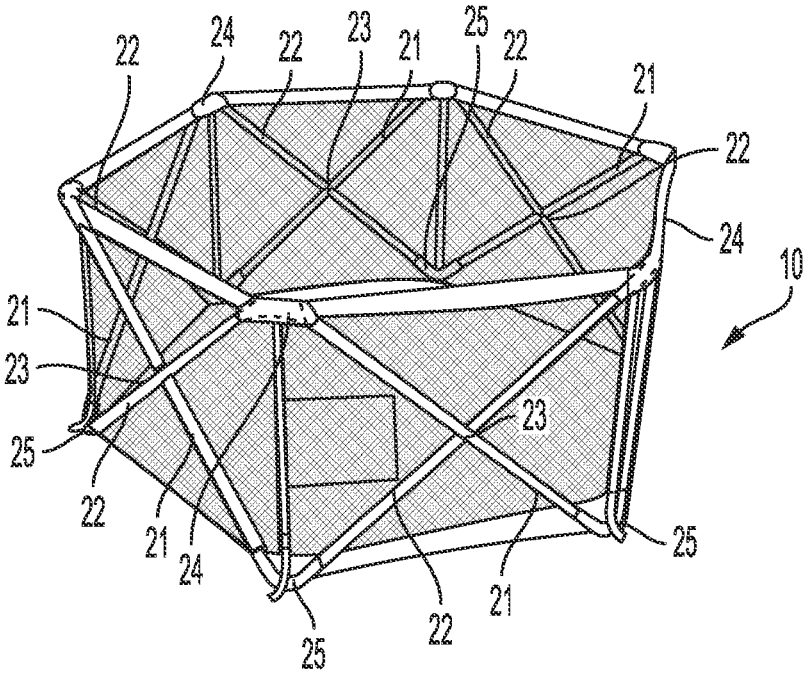
FIG. 1 is a perspective view of a playard in its upright, uncollapsed, position.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

Figure 2:
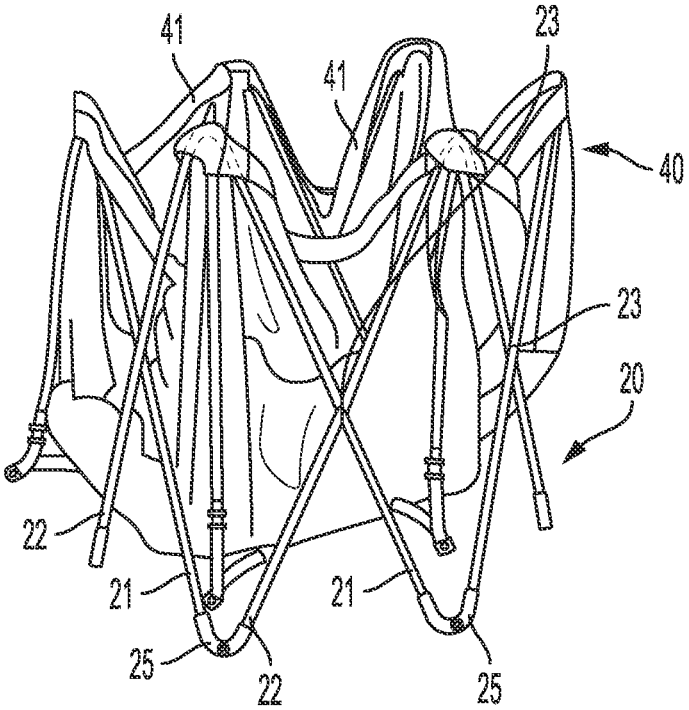
FIG. 2 is a perspective view of the playard of FIG. 1 in a partially collapsed position.

As shown in FIG. 1 and FIG. 2, an exemplary folding playard 10 includes at least a frame 20, and a fabric enclosure 40 mounted on the frame 20. The frame 20 is composed of an array of scissoring tube pairs 21, 22 making up a total of at least four sides. These pairs of tubes 21, 22 are connected in a middle with a hinge pin 23. Preferably, the tubes 21, 22 are hollow and made of steel. Alternative materials for the tubes include aluminum, wood, resin-matrixed carbon fiber, fiberglass, resin-matrixed Teflon® fiber, polycarbonate, ABS, PVC, nylon, and so forth. When the tubes 21, 22 pivot vertically, the height of the playard 10 is increased and the playard 10 collapses as shown in FIG. 2. When the tubes 21, 22 pivot in the horizontal direction, the playard 10 expands and at the tubes' 21, 22 end of travel, the playard 10 is expanded fully and in its use configuration as shown in FIG. 1.

Each of the tube pairs 21, 22 are joined at their top ends and their bottom ends to neighboring, i.e., adjacent, tube pair top and bottom ends by top and bottom knuckle linkages or knuckle hinges, 24 and 25 respectively. Knuckle linkages 24 and 25 are composed of two tube receptacles, joined with at least one hinge that enables the knuckles to pivot vertically, which allows the tube pairs 21, 22 to pivot vertically to a substantially vertical orientation which collapses the horizontal floor of the playard 10 for storing. The hinge is composed of a pair of connected tongue and groove casings and the tongues are formed with aligned holes. The two casings are secured to each other a rivet pin that extends through the aligned holes. The top and bottom knuckle linkages are further composed of two tube receiving sockets which are formed and positioned to receive the ends of tubes 21, 22. Receiving sockets are each formed with rivet openings 33 that receive rivets 36. This secures the ends of the tubes to their receiving sockets. Positioned between receiving sockets and casings are a pair of dog legged shaped spacers one on each side of casings and disposed between the pivot joint and each of the tube receiving sockets, creating a knuckle linkage having a substantially parabolic aspect. Spacer hole are provided in spacers to secure the knuckle linkages to the rail webbing as will be described below. Preferably, the knuckle linkages are composed of rigid plastic, although alternative materials may be used.

Most previous playards and playpens have non-removable fabrics. And for these previous playards and playpens that do have removable fabrics, removal requires a user to unzip sections of the fabric to release the fabrics from a top frame. In contrast, fabric enclosure 40 is removably mounted on the frame 20. More specifically, as described below, the fabric enclosure 40 is held in place on top by canopy/changer plugs while webbing support straps on an underside of the fabrics enclosure 40 are controlled by webbing slide that are snapped onto a bottom of a lower knuckle.

Figure 3:
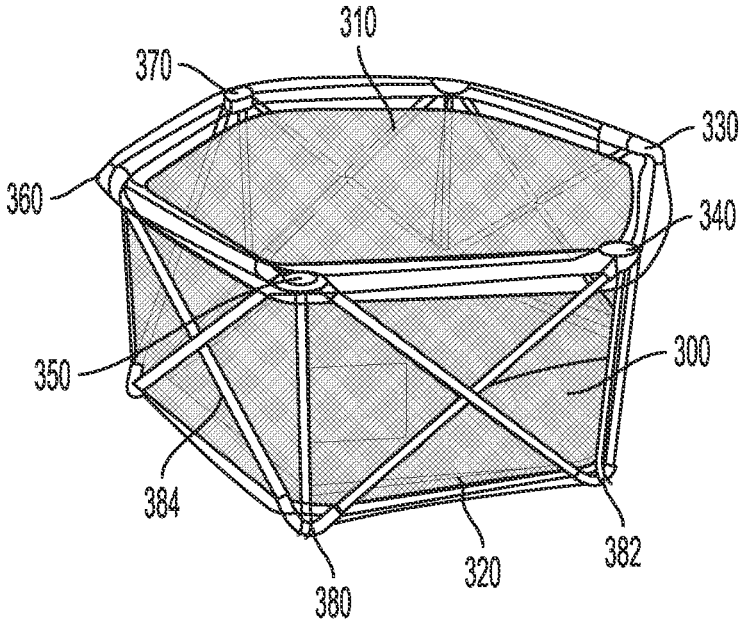
FIG. 3 illustrates a removable fabric enclosure.

As shown in FIG. 3, a fabric enclosure 300 includes a removable top portion 310 and a removable bottom portion 320. The top portion 310 is secured to an upper portion of the playard frame with cover caps 330, 340, 350, 360, 370 that may be removed from matching receptacles in the upper playard frame. When the playard is closed as shown in FIG. 2, the fabric enclosure 300 may be lifted off the upper frame. The removable bottom portion 320 includes tabs at each of the corners of the lower frame, such as tabs 380, 382, 384. Removal of the tabs 380, 382, 384 enable the fabric enclosure 300 to be removed from the playard frame.

Figure 4:
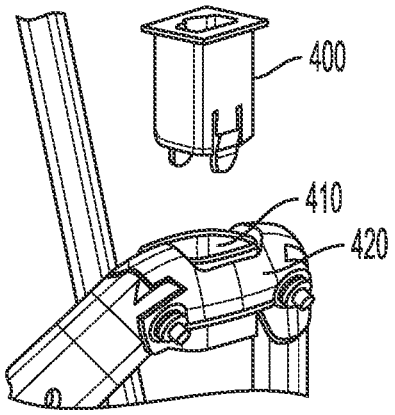
FIG. 4 illustrates a cover cap.

Referring to FIG. 4, a cover cap 400 is shown removed from a corresponding aperture 410 in the removable top portion 420.

Figure 5:
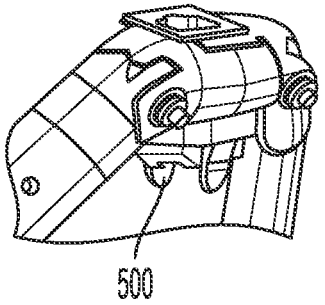
FIG. 5 illustrates a tab.

Referring to FIG. 5, a tab 500 is shown removed from a lower portion of the playard frame.

Figure 6:
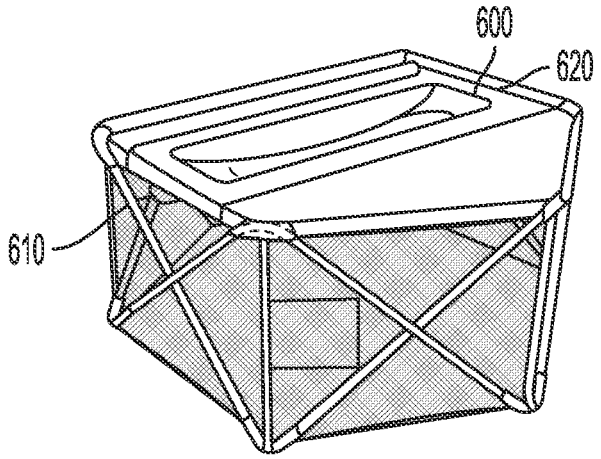
FIG. 6 illustrates a changing accessory.

As shown in FIG. 6, a changing accessory 600 includes a pair of attachment structures 610, 610. The attachment structures 610, 620 snap to corresponding mating posts located on opposing side of the upper frame of the playard. The changing accessory 600 is configured to be easily removed from the playard by disengagement of the attachment structures 610, 620 from the frame.

Figure 7:
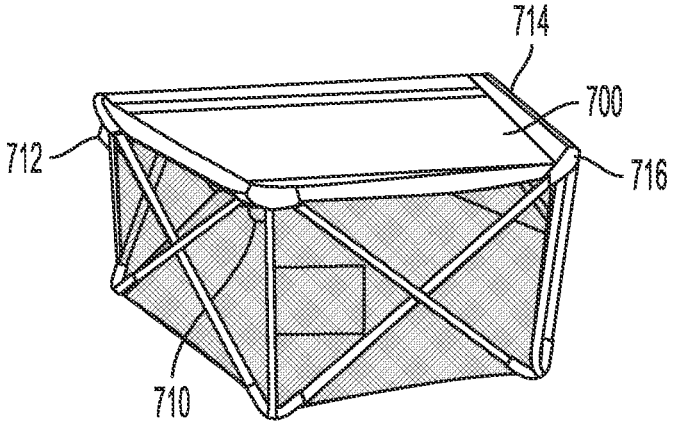
FIG. 7 illustrates a napper.

As shown in FIG. 7, a generally rectangular shaped napper 700 is secured to the four corners of playard with removable plugs 710, 712, 714, 716. A frame knuckle is molded into the frame so that a removable plug can be snapped into the knuckle. The plug has two purposes, i.e., a keyed slot in the center to allow attaching of accessories and a flange around the perimeter that traps the fabric to the frame. The accessory knuckle is a single piece plastic component that is shaped to fit into the keyed slot in the removable plug. In the center of the accessory knuckle is an integrated clip detail that snaps onto a detail in the keyed slot in the removable plug. The user aligns the accessory knuckle with the keyed slot and presses the knuckle into the plug. A distinct snap sound alerts the user that the knuckle is locked in place.

Figure 8:
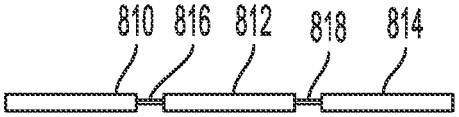
FIG. 8 illustrates a changer frame.

As shown in FIG. 8, each of two opposing sides of the napper 700 include three frame members 810, 812, 814 secures together by shock cords 816, 818. When the napper 700 is removed from the frame of the playard, the frame members may be separated, enabling the user to fold up the napper 700.

Figure 9:
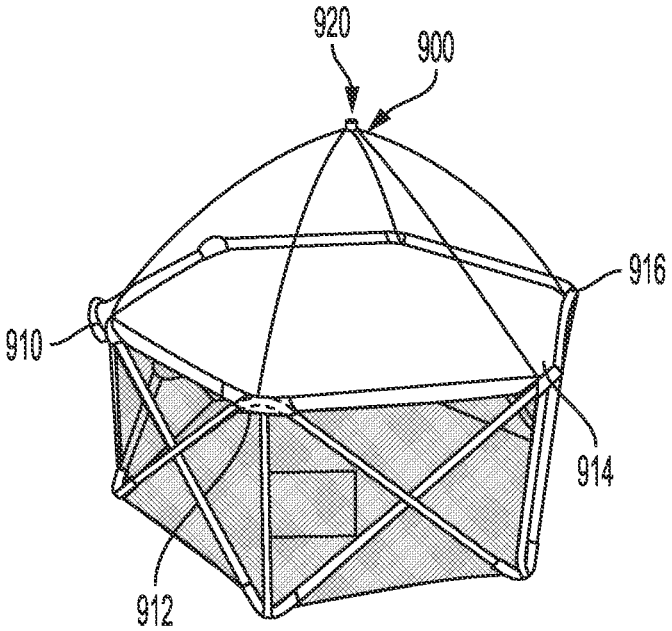
FIG. 9 illustrates a canopy.
Figure 10:
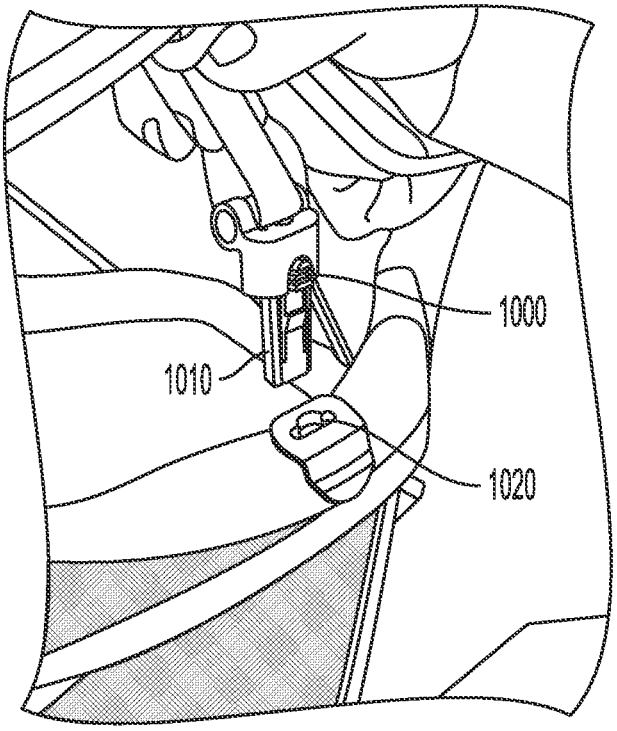
FIG. 10 illustrates a knuckle.

As shown in FIG. 9, the playard may include a canopy 900 that includes canopy stays 910, 912, 914, 916. As shown in FIG. 10, a clip 1000 attaches to an end of a canopy stay 1010 and is inserted into a receptacle 1020 in the top of a knuckle.

Referring back to FIG. 9, the canopy 900 attaches to a top of the playard that is configured to remain in place when the playard is folded. The canopy has clips attached to the bottom ends of the support structure. These clips are all hinged, however two clips, opposite of each other, have a spring loaded pin that prevents the clip from hinging. These two locked out clips are both attached independently to a release cable that runs up the inside of the canopy, and pass through to the exterior though a reinforced hole. The ends of the release cable are then attached to a handle/strap 920.

To operate the canopy fold, the user pulls and twists the handle/strap 920. This pulls the release cable to dis-engage the release pins out of the hinged clips thus allowing the clip to hinge. With the handle/strap still pulled and twisted, the user pushes the canopy down to invert the structure into the canopy toward the floor.

To set-up the canopy, the user grab the handle/strap 920 and lifts the canopy out of the playard. Once the canopy is under tension from support structure it pops into place, and the two opposite sides with the release pins engage back into the hinged knuckles to lock out the canopy.

Figure 11:
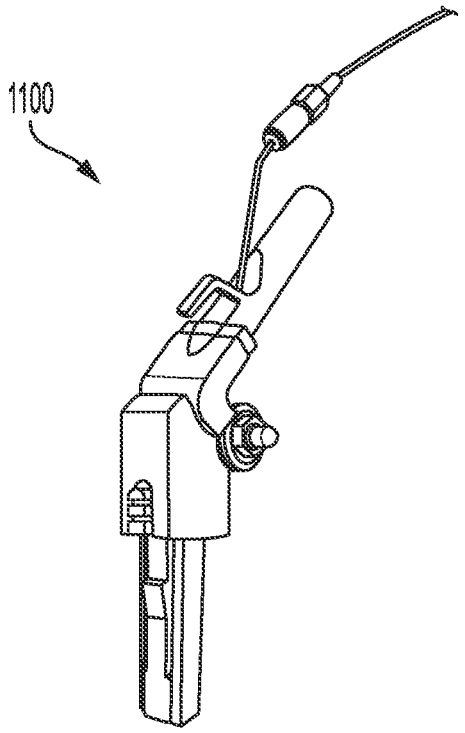
FIG. 11 illustrates the folding canopy clip.

FIG. 11 illustrates the folding canopy clip 1100 wherein the cable is attached to the handle.

Figure 12:
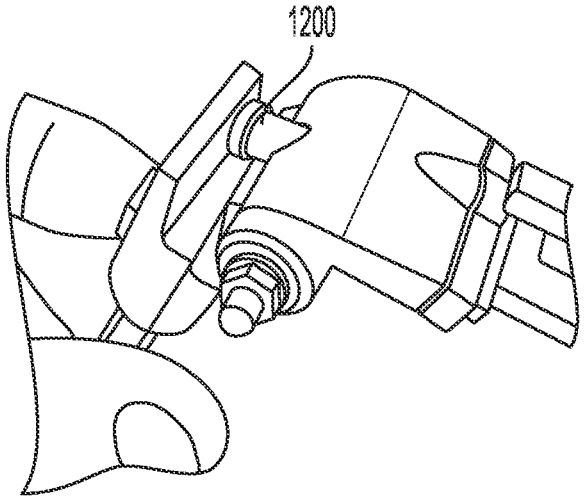
FIG. 12 illustrates a pin.
Figure 13:
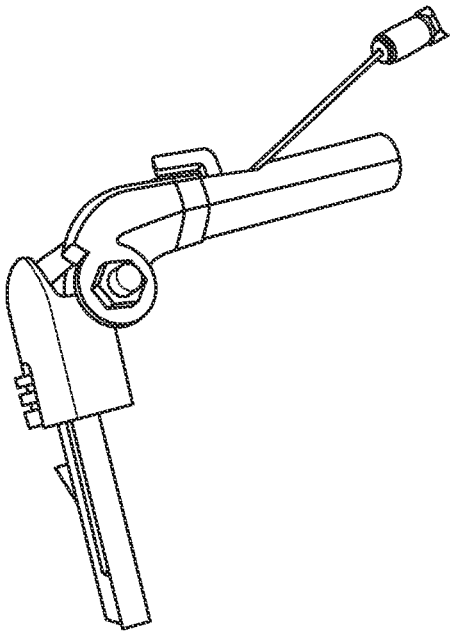
FIG. 13 illustrates a pin.

FIG. 12 illustrates the pin 1200 released out of the hole when fabric handle is pulled and twisted FIG. 13 illustrates how after pin is released the clip can rotate, allowing the canopy to fold.

Figure 14:
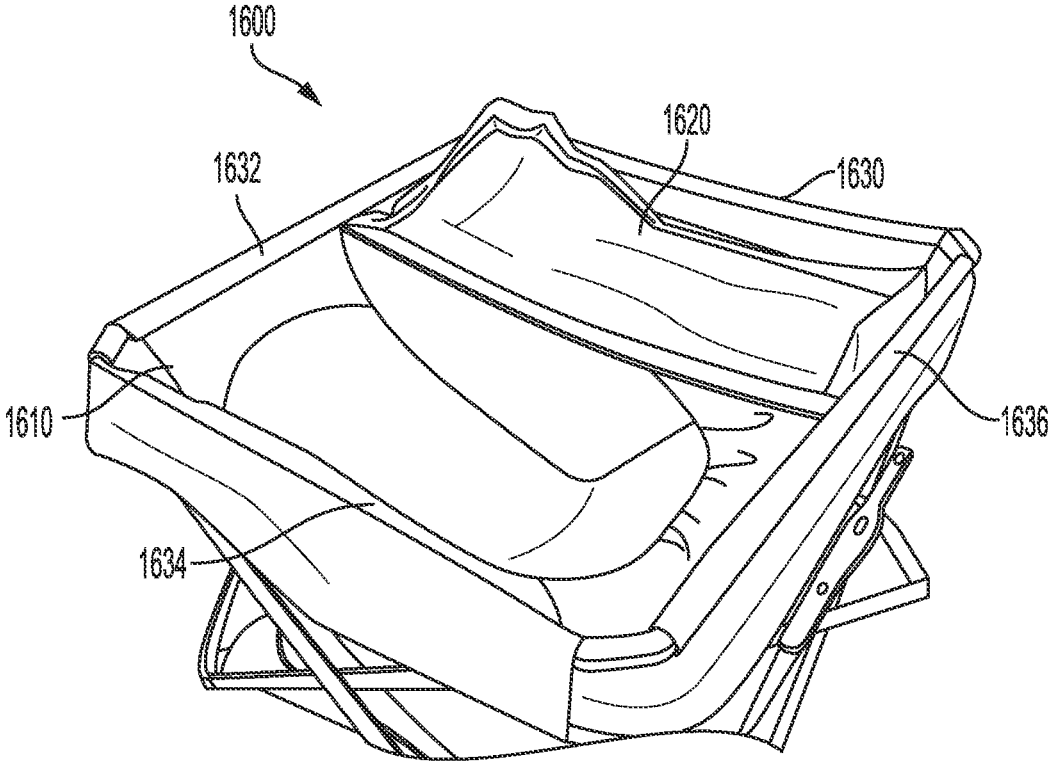
FIG. 14 illustrates an exemplary combination napper/changer.

In FIG. 14, an exemplary combination napper/changer 1600 is shown. One side of combination napper/changer 1600 is a napper (i.e., inclined sleeper) 1610 while the other side of the combination napper/changer 1600 is a changer 1620. The combination napper/changer 1600 snaps into four upper corner knuckles of the upper frame of the playard. More specifically, The napper/changer 1600 includes four horizontal tubing lengths 1630, 1632, 1634, 1636 with mounting knuckles at a top of all four corners. Two of the opposing tubes 1630, 1634 are straight with details that allow for mounting of the napper/changer 1600. The other set of opposing tubes 1632, 1636 are made of three pieces (not shown) that can be partially disassembled to allow the napper/changer 1600 to fold. The three pieces interlock with each other to form a rigid structure. They are held tight together by an elastic running up the inside of each tube.

Each of the mounting knuckles have a flexible snap detail on one side that snaps over a detail in a corner knuckle of the playard and a post going downward that helps with alignment. Once aligned, a user presses down on knuckle and a tab snaps over the detail to lock napper/changer 1600 to the frame of the playard.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An enclosure assembly comprising: a collapsible frame having an upper portion and scissoring members vertically extending and forming sides, the collapsible frame lacking horizontal top members; and a removable fabric enclosure, the removable fabric enclosure comprising: a removable top portion; and a removable bottom portion, the removable top portion being securable to the upper portion of the collapsible frame with one or more attachment devices, wherein the attachment devices comprise of one or more cover caps, the cover caps configured to be removably and vertically inserted into a corresponding one or more vertically-oriented apertures formed in the removable top portion.

2. The enclosure assembly of claim 1, further comprising:

at least one removable child support accessory, the at least one removable child support accessory comprising: attachment structures, the attachment structures configured to attachably detach to corresponding mating elements located on corresponding sides of the upper portion of the collapsible frame.

3. The enclosure assembly of claim 2 wherein the at least one removable child support accessory is a changing accessory.

4. The enclosure assembly of claim 1, further comprising:

a removable child support accessory, the removable child support accessory comprising: a generally polygonal shaped structure connected to at least two corners of a snap feature of the upper portion of the collapsible frame with attachment structures.

5. The enclosure assembly of claim 4 wherein the attachment structures are removable plugs.

6. The enclosure assembly of claim 4 wherein the snap feature is selected from the group consisting of a circlip and a saddle clip.

7. The enclosure assembly of claim 1, further comprising:

a removable canopy adapted to fold with the collapsible frame and to remain in place within the folded collapsible frame, the removable canopy comprising: a plurality of clips attached to the removable fabric enclosure, the clips hinged with two clips, opposite each other, the two clips attached independently to a release cable that runs up an inside of the canopy, and passes through to the exterior though a reinforced hole.

8. The enclosure assembly of claim 7 wherein ends of the release cable are attached to a handle/strap.

9. An enclosure assembly comprising: a collapsible frame having a lower portion, an upper portion, a first scissoring tube pair and a second scissoring tube pair, the first and second scissoring tube pairs vertically extending from the lower portion to the upper portion and forming sides, the first scissoring tube pair having a first top end and a first bottom end, the second scissoring tube pair having a second top end joined to the first top end by a top knuckle hinge, and a second bottom end joined to the first bottom end by a bottom knuckle hinge, the collapsible frame lacking horizontal top members; and a removable fabric enclosure, the removable fabric enclosure comprising: a removable top portion, the removable top portion being securable to the upper portion of the collapsible frame with one or more attachment devices, wherein the attachment devices comprise of one or more cover caps, the cover caps configured to be removably and vertically inserted into a corresponding one or more vertically-oriented apertures formed in the removable top portion; and a removable bottom portion, the removable bottom portion having one or more tabs configured to removably engage the lower portion of the collapsible frame.

10. The enclosure assembly of claim 9, further comprising:

at least one removable child support accessory, the at least one removable child support accessory comprising: attachment structures, the attachment structures configured to attachably detach to corresponding mating elements located on corresponding sides of the upper portion of the collapsible frame.

11. The enclosure assembly of claim 10 wherein the at least one removable child support accessory is a changing accessory.

12. The enclosure assembly of claim 9, further comprising:

a removable child support accessory, the removable child support accessory comprising: a generally polygonal shaped structure connected to at least two corners of a snap feature of the upper portion of the collapsible frame with removable plugs.

13. The enclosure assembly of claim 12 wherein the snap feature is selected from the group consisting of a circlip and a saddle clip.

14. The enclosure assembly of claim 9, further comprising:

a removable canopy adapted to fold with the collapsible frame, remain in place within the folded collapsible frame, and attach to the removeable fabric enclosure.

15. An enclosure assembly comprising:

a collapsible frame having a lower portion, an upper portion, and first and second scissoring tube pairs vertically extending from the lower portion to the upper portion and forming sides, the collapsible frame lacking horizontal top members; and a removable fabric enclosure, the removable fabric enclosure comprising:

a removable top portion, the removable top portion being securable to the upper portion of the collapsible frame with one or more cover caps configured to be removably and vertically inserted into a corresponding one or more vertically-oriented apertures formed in the removable top portion; and a removable bottom portion, the removable bottom portion having one or more tabs configured to removably engage the lower portion of the collapsible frame.

16. The enclosure assembly of claim 15, further comprising:

at least one removable child support accessory, the at least one removable child support accessory comprising: attachment structures, the attachment structures configured to attachably detach to corresponding mating elements located on corresponding sides of the upper portion of the collapsible frame.

17. The enclosure assembly of claim 15, further comprising:

a removable child support accessory, the removable child support accessory comprising: a generally polygonal shaped structure connected to at least two corners of a snap feature of the upper portion of the collapsible frame with attachment structures.

18. The enclosure assembly of claim 17 wherein the attachment structures are removable plugs.

* * * * *